United States Patent [19]

Nagahori

[11] Patent Number: 4,769,901

[45] Date of Patent: Sep. 13, 1988

[54] METHOD OF MAKING PTC DEVICES

[75] Inventor: Atsushi Nagahori, Ibaraki, Japan

[73] Assignee: Nippon Mektron, Ltd., Tokyo, Japan

[21] Appl. No.: 19,159

[22] Filed: Feb. 26, 1987

[30] Foreign Application Priority Data

Mar. 31, 1986 [JP] Japan ..... 61-73726

[51] Int. Cl.[4] ..... H01C 17/28

[52] U.S. Cl. ..... 29/621; 29/843; 29/612; 338/22 R; 219/91.2

[58] Field of Search ..... 29/621, 612, 619, 843, 29/844; 219/86.9, 91.2, 91.23, 117.1; 338/22 R; 228/179, 180.2

[56] References Cited

U.S. PATENT DOCUMENTS 3,748,439 7/1973 Ting et al. ..... 338/22 R 4,480,166 10/1984 Leech ..... 219/93

*Primary Examiner*—P. W. Echols

*Attorney, Agent, or Firm*—Wegner & Bretschneider

[57] ABSTRACT

A process for producing a PTC device comprising the steps of forming a laminate comprising a PTC composition and at least two electrode plates having the PTC composition sandwiched therebetween, superposing, on the surface of each of the electrode plates of the laminate, a lead plate to be electrically connected to the electrode, joining the electrode plate and the lead plate by spot welding, and during or prior to the spot welding process, forming at least one through hole penetrating through the electrode plate and the lead plate in the center of a weld. This process can minimize the heat damage of the PTC composition and the resulting PTC device has a low contact resistance.

4 Claims, 1 Drawing Sheet

METHOD OF MAKING PTC DEVICES

BACKGROUND OF THE INVENTION

This invention relates to an electrical resistance device and, more particularly, to a resistance device having the specific property of exhibiting a sharp increase in its electrical resistance as the temperature increases in a narrow temperature range (PTC, i.e, positive temperature coefficient, characteristics).

Materials having PTC characteristics can be utilized in a control device by which heat generation is ceased when a heater reaches a high temperature in a PTC thermisor, in a heat-sensitive sensor; and in a protection device. In these devices, when an excessive current flows through a circuit due to a short or the like, the current increases and therefore self-heating is developed by Joule heat. The PTC characteristics of the materials cause the resistance to increase, restricting the current to a predetermined value or less, so that when the short is released the circuit is restored. A variety of materials has been developed having PTC characteristics. For example, materials having PTC characteristics are ceramic-type materials comprising $BaTiO_3$ having a monovalent or trivalent metal oxide incorporated therein; and a polymer-type material comprising a polymer such as polyethylene having an electrically conductive material such as carbon black dispersed therein.

As shown in FIG. 3, a PTC device generally comprises a material having PTC characteristics 2 consisting of a polymer having an electrically conductive material dispersed therein (a PTC composition), metallic electrode plates 3*a* and 3*b* having the PTC composition sandwiched or interposed therebetween, and lead plates 4*a* and 4*b* connected to the electrode plates 3*a* and 3*b*, wherein each electrode plate is connected to a separate device, apparatus, power source or the like via each lead plate.

The PTC device is obtained by first preparing a PTC composition, forming this PTC composition into a film, hot pressing metallic foil electrodes to upper and lower surfaces of the film to form a laminate, cutting this laminate to a predetermined size, and providing a lead plate on the surface of each of the electrodes by soldering, welding or the like. The joining between the PTC composition and the electrode plates is carried out by hot pressing the PTC composition to the electrode plates at a temperature close to the melting point of the PTC composition.

It is desirable that the PTC device exhibit as low a resistance value as possible at room temperature (room temperature resistance) and as high a resistance value as possible at a high temperature (a peak resistance). The room temperature resistance is primarily dependent on the type of the PTC composition and the adhesion between the PTC composition and the surface of each of the electrodes. In order to reduce the room temperature resistance, the amount of the electrically conductive particles packed in the PTC composition can be increased. However, in this case, the peak resistance is decreased and therefore it is impossible to obtain a high ratio of peak resistance to room temperature resistance. In order to improve adhesion between the PTC composition and the surface of each of the electrodes, a process for decreasing the contact resistance between the PTC composition and each of electrodes has been proposed (U.S. Pat. Nos. 4,238,812 and 4,426,339).

In electrically connecting the lead plates to the electrodes of the PTC device by soldering, welding or the like, the PTC composition which is in contact with the electrode plates is heated, and a portion of the PTC composition is pyrolyzed by this heat to evolve decomposed gases. Further, a portion of the PTC composition is evaporated to evolve vapors. Thus, the adhesion between the PTC composition and the electrodes is impaired, increasing the contact resistance therebetween.

SUMMARY OF THE INVENTION

A general object of the present invention is to provide PTC device having a lower room temperature resistance while maintaining a high peak resistance.

Another object of the present invention is to provide a process for preparing an excellent PTC device having a lower value of room temperature resistance wherein the heat damage during the welding of the electrode plates and lead plates of the PTC device is alleviated and the contact resistance is decreased.

A further object of the present invention is to provide a process for producing a PTC device which electromechanically joins leads and electrode plates at low cost with ease.

Other objects of the present invention and advantages of the present invention will become apparent to those skilled in the art from the following disclosure and claim 4.

According to the present invention, the objects described above are accomplished by a PTC device comprising at least two electrode plates, a PTC composition disposed between and electrically connected to the electrode plates, and a lead plate joined to the surface of each of the electrode plates. The PTC device may have at least one through hole penetrating through the electrode plate and the lead plate.

According to another embodiment of the present invention, a process for producing a PTC device of the present invention comprises the steps of superposing a lead plate on the surface of each of electrode plates of a laminate comprising a PTC composition and at least two electrode plates having the PTC composition sandwiched therebetween; and joining the electrode plate and the lead plate by spot welding. During or prior to the spot welding process, forming at least one through hole penetrating through the electrode plate and the lead plate in the center of a weld may be formed.

In a preferred embodiment of the present process, an electrode plate and a lead plate are joined by spot welding in such conditions that two positive and negative electrodes for spot welding are brought into contact with the surface of each of the lead plates of a PTC device in the same direction, the contact area of the two positive and negative electrodes for spot welding is from 0.0025 to 4.0 sqaure millimeter and the spacing of the positive and negative electrodes for spot welding is from 0.01 to 1.0 millimeter.

DETAILED DESCRIPTION OF THE INVENTION

Figure 1:
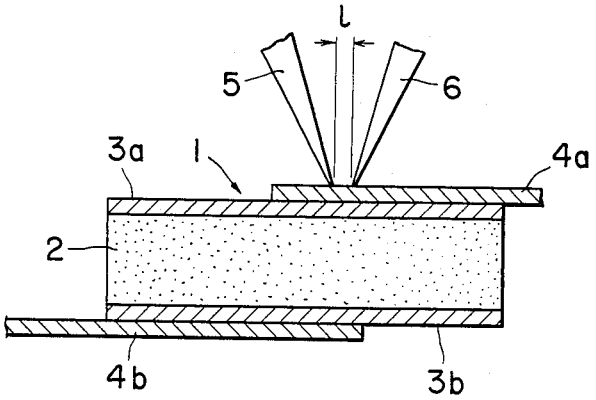
FIG. 1 is a sectional view of a PTC device illustrating a process according to the present invention.

The present invention will be more fully described.

A PTC device according to the present invention usually comprises at least two electrodes, a PTC composition disposed between the electrodes, and leads fixed to the electrodes. Examples of such PTC compositions include $BaTiO_3$ having a monovalent or trivalent metal oxide incorporated therein, and a mixture of a polymer and electrically conductive particles.

Examples of the polymers which can be used in the present invention include polyethylene, polyethylene oxide, polybutadiene, polyethylene acrylates, ethylene-ethyl acrylate copolymers, ethylene-acrylic acid copolymers, polyesters, polyamides, polyethers, polycaprolactam, fluorinated ethylene-propylene copolymers, chlorinated polyethylene, chlorosulfonated polyethylene, ethyl-vinyl acetate copolymers, polypropylene, polystyrene, styrene-acrylonitrile copolymers, polyvinyl chloride, polycarbonates, polyacetals, polyalkylene oxides, polyphenylene oxide, polysulfones, fluoroplastics, and blend polymers of at least two polymers selected from the polymers described above. In the present invention, the polymers and compositional ratios can be varied depending on desired performance, uses or the like.

Examples of electrically conductive particles dispersed in the polymer which can be used in the present invention are particles of electrically conductive materials such as carbon black, graphite, tin, silver, gold, and copper.

In preparing the PTC composition, optional various additives can be used in addition to the polymer and the electrically conductive particles described above. Such additives include flame retardants such as antimony-containing compounds, phosphorus-containing compounds, chlorinated compounds and brominated compounds, antioxidants and stabilizers.

The PTC composition according to the present invention is prepared by blending and kneading its raw materials, the polymer, the electrically conductive particles and other additives in predetermined ratios.

The PTC device of the present invention comprises the PTC composition described above and at least two electrodes which are in contact with the PTC composition. Such electrode materials which can be used herein are metals which can be used as conventional electrodes. Examples of such electrode materials include nickel, cobalt, aluminum, chromium, tin, copper, silver, iron (including iron alloys such as stainless steel), zinc, gold, lead, and platinum. The shape and size of the electrodes can desirably be varied depending on the uses of the PTC device or the like. In the present invention, the surface of the metallic electrode can be subjected to electrodeposition treatment or the like to form a rough surface, providing a number of fine projections thereon. Such projections are provided on at least the surface of the electrode which comes into contact with the PTC composition.

One embodiment of a process for producing a PTC device will be described.

A PTC device can be produced by forming the resulting composition into, for example, a film, hot pressing metallic electrodes to upper and lower surfaces of the film to form a laminate, cutting this laminate to a predetermined size, and joining and fixing a lead to the surface of each of the electrodes by spot welding.

The joining between the electrode and the lead according to the present invention is carried out by spot welding. During the spot welding process, at least one hole penetrating through the electrode plate and the lead plate can be formed in the center of the weld. Alternatively, at least one hole is previously formed in the electrode plate and the lead plate, and spot welding can be carried out at its perimeter.

An embodiment of spot welding in the present invention is described with reference to the drawings.

As shown in FIG. 1, each of lead plates 4*a* and 4*b* for external connection is superposed on the surface of each of the electrode plates of a laminate comprising a PTC composition 2 and electrode plates 3*a* and 3*b* having the PTC composition 2 sandwiched therebetween. A positive and a negative electrode 5 and 6 for spot welding are then brought into contact with the surface of a lead plate 4*a*, preferably in the same direction. Thereby, the current path produced during the spot welding can be concentrated into a certain portion to form one through hole. For the same reason, the area at which the positive and negative electrodes for spot welding come into contact with the surface of the lead plate 4*a* can be set at from 0.0025 to 4.0 square millimeter, preferably from 0.01 to 0.7 square millimeter. The spacing l between the positive and negative electrodes for spot welding can also be set at from 0.01 millimeter to 1.0 millimeter, preferably no more than 0.3 millimeter. The output of spot welding is set at, for example, from 1.5 to 50 W.s.

Figure 2:
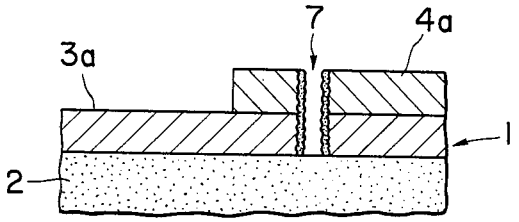
FIG. 2 is a partially enlaraged sectional view of a PTC device after spot welding according to the present invention.
Figure 3:
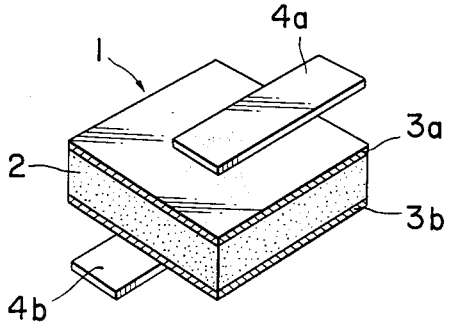
FIG. 3 is a perspective view of a general PTC device.

As shown in FIG. 2, in the present invention, one through hole 7 penetrating through the electrode plate 3*a* and the lead plate 4*a* in the center of a weld is formed by the spot welding described above. In this embodiment, a molten portion is formed by the welding on the inner wall of the through hole 7.

The present invention is not restricted to the embodiment described above and a plurality of through holes can be formed.

In the present invention, an optional resin film can be formed on the surface of the PTC device. Examples of resins from which the resin film can be produced include epoxy resins, phenolic resins, polyethylene, polypropylene, polystyrene, polyvinyl chloride, polyvinyl acetate, polyvinyl alcohol, acrylic resins, fluoroplastics, polyamide resins, polycarbonate resins, polyacetal resins, polyalkylene oxides, saturated polyester resins, polyphenylene oxide, polysulfones, poly-para-xylene, polyimides, polyamide-imides, polyester imides, polybenzimidazole, polyphenylene sulfides, silicone resins, urea resins, melamine resins, furan resins, alkyd resins, unsaturated plyester resins, diallyl phthalate resins, polyurethane resins, blend polymers thereof, and modified resins wherein the resins described above are modified by reaction of the resin with a chemical reagent, by crosslinkage with radiation, by copolymerization or the like. Of these resins, the preferred resins are epoxy resins and phenolic resins. Various additives such as plasticizers, curing agents, crosslinking agents, antioxidants, fillers, antistatic agents and flame retardants can be incorporated in the resins. The resins used in the present invention have at least electrically insulating properties and can adhere to the surface of the PTC device. Processes for coating the resin are not limited, and coating can be carried out by spraying, spreading, dipping or the like. Further, after coating the resin, curing can be carried out by a process such as chemical treatment, heating or irradiation. The curing processes can be varied depending on the type of the resins.

EXAMPLES

In order to indicate more fully the nature and utility of this invention, the following examples are set forth, it being understood that these examples are presented as illustrative only and are not intended to limit the scope of the invention. All percentages used herein are by weight unless otherwise specified.

EXAMPLE 1

A PTC composition comprising the following components was prepared.

| Component | % |
|---|---|
| Polymer: high density polyethylene (available from Tokyo Soda Co. under the tradename Niporan Hard 5100) | 60 |
| Electrically conductive particles: carbon black (available from Cabot Co. under the tradename STERLING V) | 38 |
| Additive: antioxidant (Irganox 1010) | 2 |

This composition was kneaded by means of a twin-roll mill and formed into a film having a thickness of 300 micrometers by means of an extrusion molding machine or roll molding machine. Nickel foil electrodes having a thickness of 60 micrometers were hot pressed to the upper and lower surfaces of the film to form a laminate. Preferably, the surfaces of the electrodes are roughened. The resulting laminate was cut into a predetermined size (10×10×0.25 mm).

On the other hand, a lead plate is provided and this plate is superposed on the surface of the electrode plate of the laminate. As shown in FIG. 1, two wedge-shaped electrodes for spot welding are brought into contact with the surface of the lead plate in the same direction. The spacing between the wedge-shaped electrodes, the total contact area and the welding energy were set at 0.3 millimeter, 0.5 square millimeter and 5 W.s, respectively.

After welding, a 0.25×0.6 millimeter through hole had been formed. When the electric resistance of the PTC device at room temperature after or before welding was measured, no substantial increase in contact resistance was observed.

What is claimed is:

1. A process for producing a PTC device which comprises the steps of forming a laminate comprising a PTC composition and at least two electrode plates having the PTC composition sandwiched therebetween; superposing, on the surface of each of the electrode plates of the laminate, a lead plate to be electrically connected to the electrode; and joining the electrode plate and the lead plate by spot welding, and prior to or during the spot welding process, forming at least one through hole penetrating through the electrode plate and the lead plate at a weld.

2. The process according to claim 1 wherein a positive and a negative electrode for spot welding are brought into contact with surface of said lead plate in the same direction.

3. The process according to claim 2 wherein the contact area of the positive and negative electrodes for spot welding is from 0.0025 to 4.0 square millimeter.

4. The process according to claim 2 wherein the spacing of the positive and negative electrodes for spot welding is from 0.01 to 1.0 millimeter.

* * * * *